US006571418B2

(12) United States Patent
Slager, Sr.

(10) Patent No.: US 6,571,418 B2
(45) Date of Patent: Jun. 3, 2003

(54) LIQUID FLOOR COATING APPLICATOR

(76) Inventor: David P. Slager, Sr., 747 W. Old Monee Rd., Crete, IL (US) 60417

( * ) Notice: Subject to any disclaimer, the term of this patent is extended or adjusted under 35 U.S.C. 154(b) by 106 days.

(21) Appl. No.: 09/817,378

(22) Filed: Apr. 3, 2001

(65) Prior Publication Data

US 2002/0138933 A1 Oct. 3, 2002

(51) Int. Cl.[7] ..... A47L 13/20
(52) U.S. Cl. ..... 15/118; 15/144.1; 15/229.6
(58) Field of Search ..... 15/118, 144.1, 15/228, 229.1, 229.2, 229.3, 229.4, 229.5, 229.6, 229.7, 229.8, 229.9; 118/264

(56) References Cited

U.S. PATENT DOCUMENTS 1,169,958 A * 2/1916 Hurt
1,208,443 A * 12/1916 Anderson
1,398,772 A 11/1921 Anderson
1,966,633 A 7/1934 Lee
2,438,354 A 3/1948 Unterbrink
2,984,854 A 5/1961 Johnson
3,991,432 A * 11/1976 Griffin
4,070,726 A 1/1978 Joffre
4,152,084 A * 5/1979 Melton et al.
4,530,130 A * 7/1985 Moss
5,397,622 A 3/1995 Thomas
5,419,015 A * 5/1995 Garcia
5,591,507 A 1/1997 Jones
6,023,809 A * 2/2000 Demetriades
6,047,435 A * 4/2000 Suzuki et al.

* cited by examiner

*Primary Examiner*—Terrence R. Till
(74) *Attorney, Agent, or Firm*—Evan D. Roberts

(57) ABSTRACT

A floor coating applicator having a pad affixed to a frame and having cord strands extending outwardly from part of the periphery of the pad and adapted to be manipulated over a floor surface by a handle affixed to the frame.

7 Claims, 1 Drawing Sheet

LIQUID FLOOR COATING APPLICATOR

BACKGROUND OF THE INVENTION

The field of this invention relates generally to floor coating applicators for applying, and otherwise spreading, a liquid coating uniformly over a floor or similar surface.

Prior art discloses such things as dry dust mop pads. Some mops having yarn strands extending around the entire periphery and, in some instances, between the body of the mop and the floor surface to which it is to be applied.

Some prior art disclose cleaning pads having an abrasive or cleaning material combined with high absorbent material for collecting material removed by the cleaning material.

Prior art also discloses mops and related devices that have a handle connected midway of a mop for moving the mop over a surface to be mopped.

SUMMARY OF THE INVENTION

The nature and substance of this invention is to provide a pad, such as lambs wool secured to a frame, to apply liquid coatings to a surface with one finish pass over the surface without leaving excess fluid streaks or over run fluid ridges along the sides, front or back of the pad as it is applied to the surface. Because of the nature of a natural lambs wool pad, it retains the liquid and dispenses it more evenly along the total area thereof than does a natural or synthetic yam type of pad.

When a lambs wool pad is moved across a surface, by a handle secured to the frame, liquid can be released from the pad in extremely even coats in the direct path of the lambs wool pad without the streaks associated with a yarn pad or other synthetic fiber pads. Often the surface being coated may have debris, which will cause a yam pad or other synthetic fill pads to leave streaks because these pads tend to drag the debris along the surface. The natural lambs wool pad allows this same debris to be engulfed into the fibers of wool. This tends to eliminate the chance of debris being dragged over the treated or coated surface through the finish.

The lambs wool pad, of this invention, has yam strands extending from the front and side edges. As the pad is moved forwardly over a liquid on the surface with the rear, or trailing side without the yam, following behind the natural lambs wool pad, the pad will tend to leave a smooth even thickness of liquid under, and in the path of, the pad as it moves over the liquid in a squeegee-like manner. A problem arises, however, because the liquid along the sides of the pad tend to leave a noticeable fluid run over ridge. The yam on the sides of the pad of this invention will evenly spread the coating, by feathering, or smoothing out these excess run over ridges.

Another problem arises when a pad is pushed forwardly into an area to spread applicant. In this event, where the pad stops and is then pulled in the opposite or reverse direction to continue the coating process, a noticeable over run line will tend to be left in the coating in front of the pad at this stop and reverse location.

It is an object of this invention to provide a floor coating applicator which can spread a liquid floor coating in two directions in a modified squeegee-like manner.

It is a further object of this invention to provide a floor coating applicator having an absorbent pad that will release and move floor treating fluid in a uniform film manner as it is moved over a floor or similar surface.

Another object of this invention is to provide a floor coating applicator having fluid spreading pad secured to a frame having a handle that is adjustably secured to the frame to facilitate manipulation of the frame and pad as the pad is moved to and from over a surface to be coated.

Also, an object of this invention is to provide a floor coating applicator having the pad and frame adjustably secured to a handle whereby a floor applying plane of the coating pad can be positioned, by the handle, in a plane parallel to a horizontal plane through the handle so that the applicator can be manipulated by the handle under low, or nominal, clearance spaces above the floor to be treated.

A still further object of this invention is to provide a floor coating applicator having yam strands extending outwardly from the front and two sides of the pad to feather, or smooth out, fluid run over, or run out, ridges caused by the squeegee-like action of the pad when it is moved to and from.

Other advantages, objects and novel aspects of this invention will become apparent upon the following detailed description, in conjunction with the accompanying drawings wherein.

Figure 1:
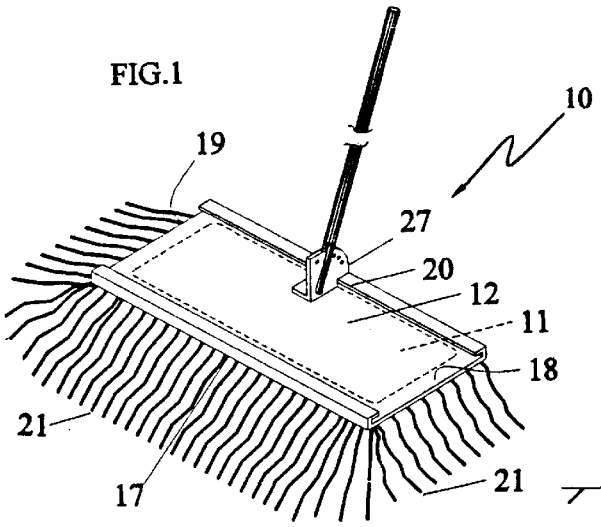
FIG. 1 is a perspective view of the liquid floor coating apparatus of this invention showing a frame with side yarn strands extending from the front and two sides thereof and the handle mounted closer to the non-stranded rear edge of the pad than to the stranded front edge.

The liquid floor coating applicator of this invention is generally designated by the numeral 10 (FIGS. 1–5) and generally includes an applicator pad 11, a pad retaining frame 12, and a manipulating handle 13.

Pad 11 (FIGS. 1–4) is preferably comprised of sheep or lambs wool to provide absorbing and dispensing of floor treating fluid 15 (FIG. 5) to floor 16 (FIGS. 2–3) and has a front edge surface 17 (FIGS. 1–4), two side edge surfaces 18 and 19, and a rear edge surface 20. A series of yarn strands 21 (FIGS. 2–4) are secured to pad 11 front edge surface 17, and to side edge surfaces 18 and 19 (FIGS. 1–4) to normally extend radially outwardly (FIG. 1) from pad 11.

Figure 2:
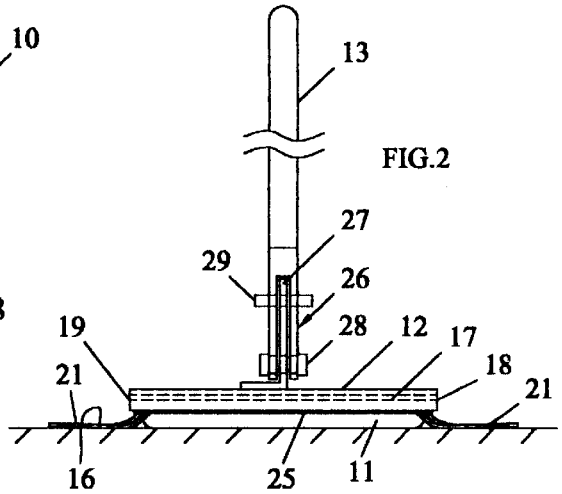
FIG. 2 is a front view of the liquid floor coating apparatus of this invention showing the application of the pad and front yarn strands thereof to a floor surface.
Figure 4:
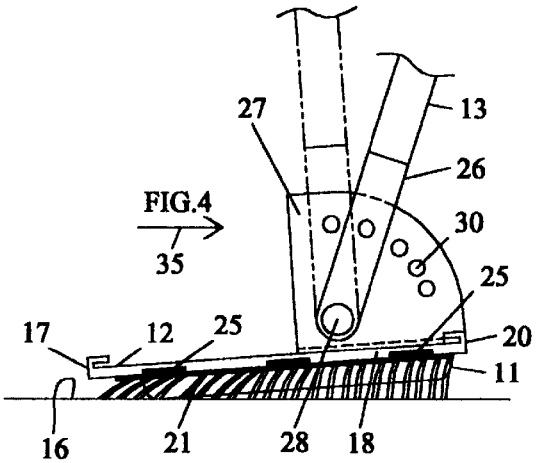
FIG. 4 is a side view of the liquid floor coating apparatus of this invention showing the angular application of the pad and yarn strands thereof to a floor surface while it spreads treating or coating fluid as the apparatus is moved rearwardly away from the operator.
Figure 3:
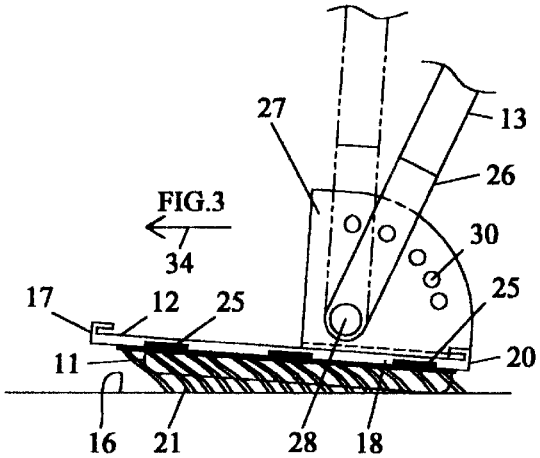
FIG. 3 is a side view of the liquid floor coating apparatus of this invention showing the angular application of the pad and yarn strands thereof to a floor surface while it spreads treating or coating fluid as the apparatus is moved forwardly away from the operator.
Figure 5:
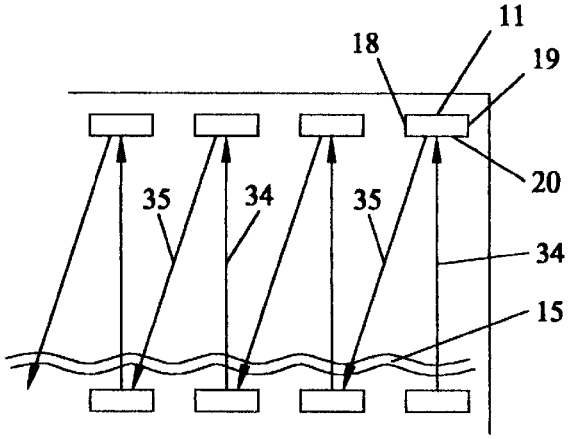
FIG. 5 is a schematic drawing showing the path of the apparatus being pushed forwardly and rearwardly as it respectively applies treating or coating fluid and evens out treating or coating fluid over a surface.

Frame 12 (FIGS. 1–5) is somewhat larger than pad 11 and is adapted to be removably secured to, and to retain, pad 11. The preferred method for retaining pad 11 to frame 12, is by interlocking flexible burr material 25 (FIGS. 2 and 3) between frame 12 and pad 11 so that pad 11 can be readily removed and replaced from time to time. Handle 13 (FIGS. 1 and 2) has a clevis lower end portion 26 adapted to fit over a frame bracket 27 extending from frame 12. A pivot pin 28 pivotally connects handle clevis portion 26 to frame bracket 27 (FIGS. 2–4). Handle 13 is locked in alternate angular positions (FIGS. 3 and 4) relative to frame 12 by locking pin 29 (FIG. 2) inserted in selected bracket apertures 30 and clevis 23 to allow handle 13 to be retained at a selected angle to frame 12 to manipulate frame 12 and pad 11 relative to floor surface 16 to be coated, depending on whether applicator 10 is to be moved in the forward direction 34 (FIGS. 3 and 5) or in the rearward direction 35 (FIGS. 4 and 5).

It should be noted that frame bracket 27 is specifically positioned more toward frame rear edge 20 of frame 12 than to frame front edge 17 to provide specific frictional control of the angle of frame pad 11 to floor 16 (FIGS. 3 and 4).

In the alternative, handle 13 can be freely pivotally connected to frame bracket 27 for an alternative mode of manipulation of pad 11 and frame 12 over floor 16.

This alternative free pivoting of handle 13 on frame 12 allows friction between floor 16 and pad 11, when pad 11 is moved over floor 16, to cause frame 12 and pad 11 to twist on pin 28 (FIGS. 3 and 4) depending on which direction frame 12 and pad 11 are frictionally moved over floor 16.

In operation of applicator 10, floor treating liquid 15 (FIG. 5) is poured on floor 16 in the general areas to be treated. Pad 11 is applied to frame 12 and by manipulation of handle 13, pad 11 is moved forwardly 34 in the treating fluid on the floor 16 to absorb treating fluid 15 into pad 11. Pad 11 is thereafter manipulated via handle 13 by moving pad 11 forwardly 34 (FIGS. 4 and 5) over treating fluid 15 with pad rear edge pad surface 20 moving across floor 16 in a squeegee-like action (FIG. 3) with front edge surface 17 of pad 11 somewhat elevated from floor 16. This will spread treating fluid 15 in a squeegee-like fashion away from the operator to an extended or stop position (FIG. 5) on floor 16.

Operator thereafter will rotate handle 13 upwardly to move front pad edge surface 17 onto floor 16 with front edge strands 21 on floor 16 and raising rear pad edge surface 20 slightly off of floor 16. Operator thereafter pulls handle 13 toward himself in rearward direction 35 (FIGS. 4 and 5) drawing pad 11 rearwardly 35 (FIG. 5) in a mild squeegee-like fashion (FIG. 4). During this rearwardly action 35 of pad 11, strands 21 of front edge 17 engage floor 16 at stop position (FIG. 5) on floor 16 when applicator 10 is reversed from forward motion 34 (FIG. 4) to rearward motion 35 (FIG. 5). As pad 11 is moved rearwardly 35 (FIGS. 3 and 5), strands 21 on front edge 17 and sides 18 and 19 will engage treating fluid 15 during rearward movement 35 and feather, or smooth out, overrun of treating fluid 15 which would otherwise tend to form ridges at stop position between forward movement 34 and rearward motion 35.

Similarly, as applicator 10 is moved rearwardly (FIGS. 3 and 5), yam strands 21 on pad sides 18 and 19 will feather, or smooth out, side overrun treating fluid 34 which would otherwise tend to form ridges along the sides 18 and 19 of pad 11 on path 35 of applicator 10.

It is to be understood that the invention is not to be limited to the specific construction and arrangements shown and described, as it will be understood to those skilled in the art that certain changes may be made without departing from the principles of the invention.

What is claimed is:

1. A liquid floor coating applicator comprising a frame having a top and bottom surface with a peripheral edge surface there between, a high absorbency pad having a floor engaging plane surface and positioned on said bottom surface and adapted to absorb floor treating fluid and to release the fluid onto the floor surface to be coated, means for securing said pad to said bottom surface of said frame, said pad having a peripheral surface, absorbent non-continuous cord strands secured to the peripheral surface of said pad and extending generally outwardly away from said pad peripheral surface and generally parallel to the floor surface to be coated when said pad is applied to the floor surface, a handle, and means for securing said handle to said frame whereby said applicator can be angularly manipulated with said pad by said handle at selected angles to a floor surface to effect control of the application and spreading of fluid on the floor by said applicator.

2. A liquid floor coating applicator as defined in claim 1 wherein said pad has a peripheral surface generally complimentary with said peripheral surface of said frame whereby when said applicator frame is manipulated said pad will be exposed to, and applied to, the floor in a squeegee-like fashion.

3. A liquid floor coating applicator as defined in claim 1 wherein said frame has a straight front peripheral edge and a straight opposite rear peripheral edge.

4. A liquid floor coating applicator as defined in claim 3 wherein said front and rear edges are parallel.

5. A liquid floor coating applicator as defined in claim 4 wherein said cord strands are secured to all peripheral edge surfaces of said pad except said pad front rear surface.

6. A liquid floor coating applicator as defined in claim 5 wherein said means for securing said handle to said applicator frame is sufficiently rigid whereby when said applicator is moved over the floor forwardly in the direction of said front frame edge said frame front edge can be manipulated by said handle to raise said front edge off of the floor and retain said rear edge on the floor and alternately when said applicator is moved over the floor rearwardly in the direction of said frame rear frame edge said rear edge can be manipulated by said handle to raise said rear edge off of the floor and retain said front edge on the floor to effect forward and rearward respective application affects.

7. A liquid floor coating applicator as defined in claim 6 wherein said handle is freely pivotally connected to said frame and closer to said rear edge surface of said frame than to said front edge surface of said frame whereby when said applicator is moved frictionally forwardly over a floor surface, by said handle, said frame will have less tendency to pivot relative to said handle than when said applicator is moved rearwardly over a floor surface.

* * * * *